US005282575A

United States Patent [19]

Krulick et al.

[11] Patent Number: 5,282,575

[45] Date of Patent: Feb. 1, 1994

[54] HIGH PRESSURE SCREEN SHOWER

[75] Inventors: Thomas G. Krulick, Sugarloaf, Pa.; Gregory Georgalas, Huntington, Conn.; John P. Skitka, Allentown, Pa.; Daniel R. Connors, Trumbull, Conn.

[73] Assignee: Dorr-Oliver Incorporated, Milford, Conn.

[21] Appl. No.: 873,453

[22] Filed: Apr. 24, 1992

[51] Int. Cl.[5] ..... B05B 3/18

[52] U.S. Cl. ..... 239/255; 239/261; 239/263.1; 239/752; 134/172; 162/277

[58] Field of Search ..... 239/251, 255, 261, 263.1, 239/264, 752, 753, 236, 225.1; 134/172, 122 R; 162/277

[56] References Cited

U.S. PATENT DOCUMENTS

| | | | |
|---|---|---|---|
| 3,169,706 | 2/1965 | Ross | 239/752 |
| 3,642,208 | 2/1972 | Guth | 239/255 |
| 4,087,320 | 5/1978 | Danahy et al. | 239/752 X |
| 4,255,906 | 3/1981 | Hockett | 239/255 X |
| 4,605,472 | 8/1986 | Nakamura | 239/752 X |

FOREIGN PATENT DOCUMENTS

| | | | |
|---|---|---|---|
| 103708 | 1/1963 | Netherlands | 134/172 |

*Primary Examiner*—Andres Kashnikow
*Assistant Examiner*—Lesley D. Morris
*Attorney, Agent, or Firm*—DeLio & Peterson

[57] ABSTRACT

A shower system for a screening machine or unit. The shower system includes a spray nozzle connected to a movement arm, a driver for longitudinally moving the movement arm in a reciprocal path, and an indexing system adapted to allow limited axial rotation of the movement arm at predetermined longitudinal positions of the movement arm.

10 Claims, 4 Drawing Sheets

HIGH PRESSURE SCREEN SHOWER

BACKGROUND OF THE INVENTION

1. Field of the Invention

The present invention relates to cleaning systems and methods and, more particularly, to a shower system and method for cleaning a screen surface of a screening machine or unit.

2. Prior Art

Various different types of shower systems are known in the prior art. Shower systems for cleaning screen surfaces have included fixed pipe systems, translating pipe systems, or rotating pipe systems. For fixed pipe systems a considerably large number of nozzles is required to clean the screen surface and, do not do a complete cleaning of the entire screen surface. Although rotating or translating pipe systems are capable of cleaning the entire screen surface, these types of systems nonetheless also require a large number of nozzles and a larger pump. Because the pump is a large portion of the overall cost of such systems, this obviously increases the costs of such systems.

It is therefore an objective of the present invention to provide a new and improved shower system and method of cleaning.

SUMMARY OF THE INVENTION

In accordance with one embodiment of the present invention, a shower system is provided comprising a spray nozzle, a movement arm, and means for moving the movement arm. The movement arm has the spray nozzle connected thereto. The means for moving the movement arm can move the arm in a reciprocating longitudinal path and an axial rotational direction. The means for moving includes means for providing axial rotation of the movement arm only upon a predetermined longitudinal movement of the movement arm.

In accordance with one method of the present invention a method of cleaning a screen surface is provided comprising steps of connecting a shower cleaning system to the screening unit, the shower cleaning system having at least one spray nozzle connected to a movement arm, the arm being adapted to move in a reciprocating longitudinal path and can be axially rotated; supplying a fluid to the spray nozzle; and moving the movement arm to move the spray nozzle, the step of moving the movement arm comprising longitudinally moving the movement arm in a first direction, axially rotating the movement arm at a predetermined longitudinal position of the movement arm, and longitudinally moving the movement arm in a second reverse direction after it has been axially rotated.

In accordance with another embodiment of the present invention a screening machine cleaning system is provided comprising at least one spray nozzle; a movement arm having the spray nozzle connected thereto; means for supplying fluid into the spray nozzle; means for reciprocatingly longitudinally moving the movement arm; and an indexing means for, at least partially, controlling axial rotation of the movement arm. The indexing means includes a spindle with slots for a portion of the movement arm to move therein.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
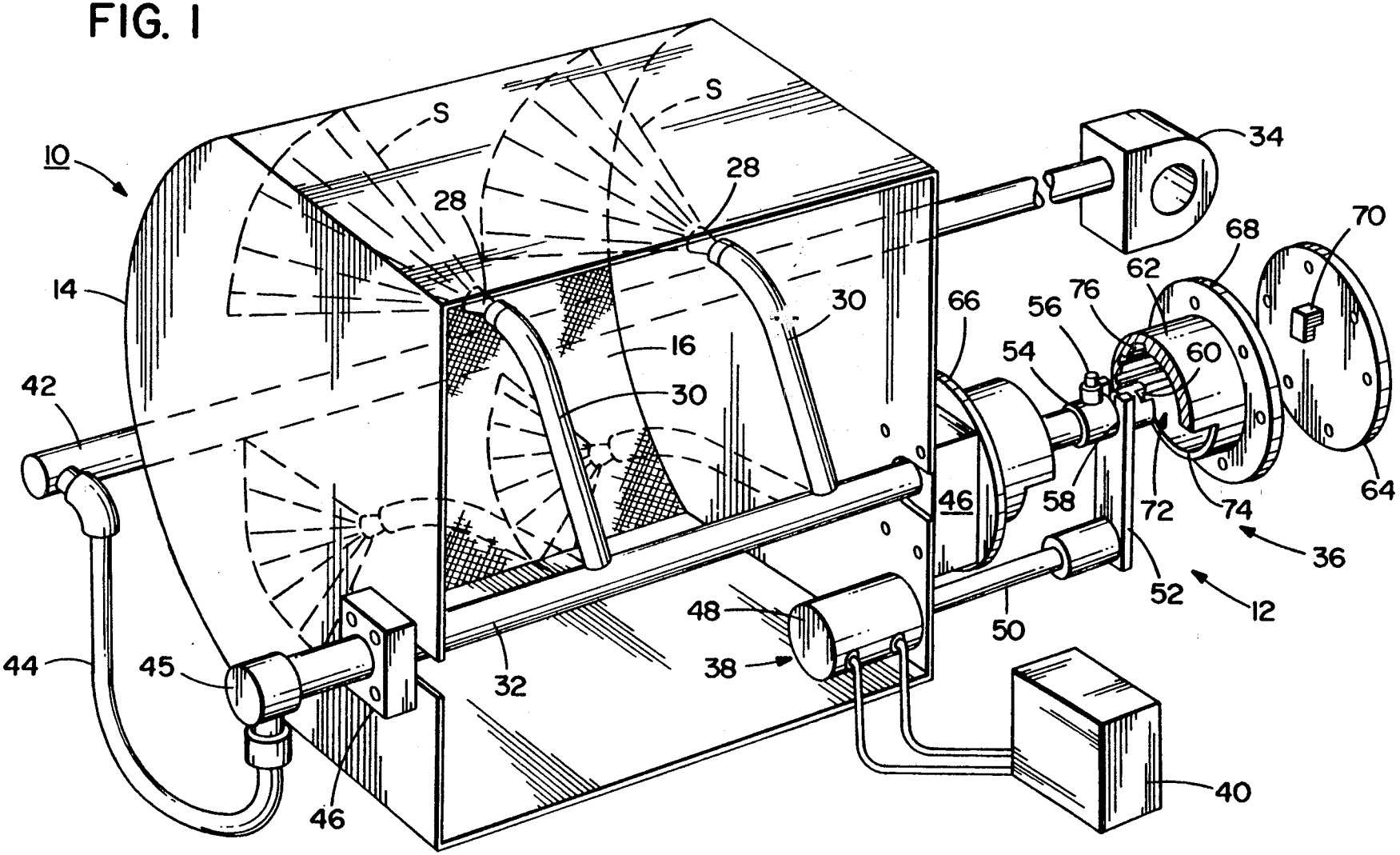
FIG. 1 is a schematic perspective view of a screening machine having a shower system incorporating features of the present invention.

Referring to FIG. 1, there is shown a schematic perspective view of a screening machine 10 having a shower system 12 incorporating features of the present invention. Although the present invention will be described with reference to the single embodiment shown in the drawings, it should be understood that the present invention can be incorporated into various different types of embodiments. In addition, any suitable size, shape and type of elements or materials can be used.

Figure 3:
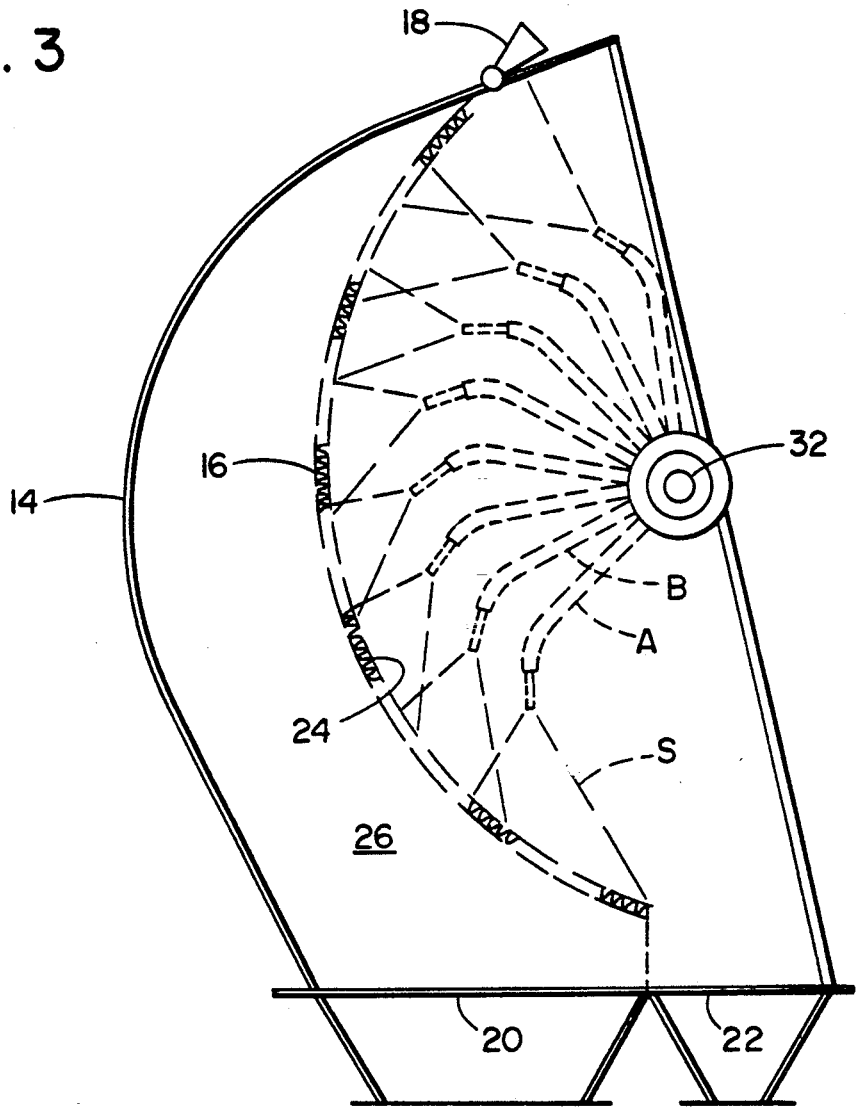
FIG. 3 is a schematic side view of the screening machine shown in FIG. 1 showing the various axial positions of the spray nozzle.

The screening machine 10 is a pulp and paper screening machine. However, the present invention can be used in any suitable type of machine. The screening machine 10, apart from the shower system 12 of the present invention, is generally known in the art. Referring also to FIG. 3, the machine 10 includes a housing 14, an arcuate screen 16, a top inlet 18, and two bottom outlets 20 and 22. Pulp is injected into the machine 10 at inlet 18 and travels down along the inside surface 24 of the screen 16. Small particles travel through the screen 16 into the rear area 26 and out the first outlet 20. Larger particles, not small enough to pass through the screen 16, travel down the inside surface 24 and out the second outlet 22. Thus, the machine 10 is adapted to separate pulp particles by size.

Figure 5:
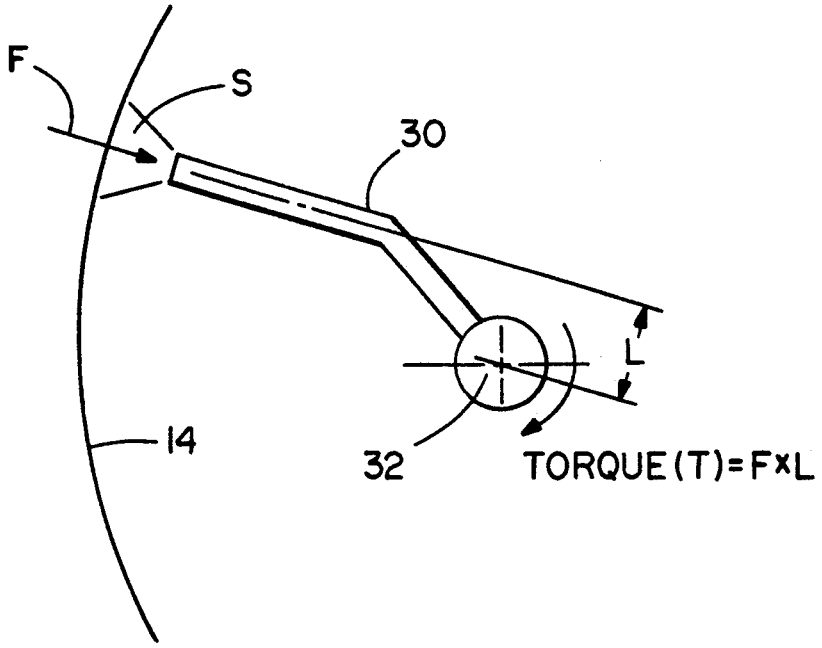
FIG. 5 is a side view of a torque arm pipe depicting the thrust torque developed due to nozzle spray discharge.

In order to keep the machine operating properly, the screen 16 must be occasionally cleaned. Thus, the shower system 12 is provided to clean the screen 16. The shower system 12 generally comprises nozzles 28, torque arms 30, movement bar or arm 32, pump 34, indexing system 36, driver 38, and controller 40, such as a computer. The pump 34 has a supply of fluid connected thereto. A pipe 42 and flexible hose 44 are used to connect the pump 34 to a first end of the movement arm 32. The flexible hose 44 and swivel joint 45 are used to accommodate movements of the movement arm 32 relative to the pipe 42. However, any suitable type of conduit system could be provided. The movement arm 32 has a channel therein. The channel is provided to conduct fluid from the hose 44 to the torque arms 30. However, any suitable type of system to conduct fluid from the hose 44 to the torque arms 30 and nozzles 28 could be provided. The movement arm 32 is moveably mounted to the housing 14 by bearing blocks 46. The bearing blocks 46 allow the movement arm 32 to longitudinally slide in the housing 14 and, axially rotate in the housing 14. The torque arms 30 are connected to the side of the movement arm 32 and have channels therein connected to the channel in the movement arm 32 to supply fluid from the movement arm to the nozzles 28. Thus, the arms 30 and 32, in addition to their other features explained in better detail below, also function as a means for conducting fluid from the hose 44 to the nozzles 28. The torque arms 30 generally extend away from the movement arm 32 in a radial direction. Although the torque arm is bent so that there is a torque acting on the movement arm 32 causing the arm to rotate upward as shown in FIG. 5, the torque arm is designed so that the nozzle is approximately perpendicular to the screen. Although only two torque arms are shown in the embodiment in the drawings, it should be understood that any suitable number of torque arms could be provided. Located at the end of each torque arm 30 is one of the nozzles 28.

Figure 2:
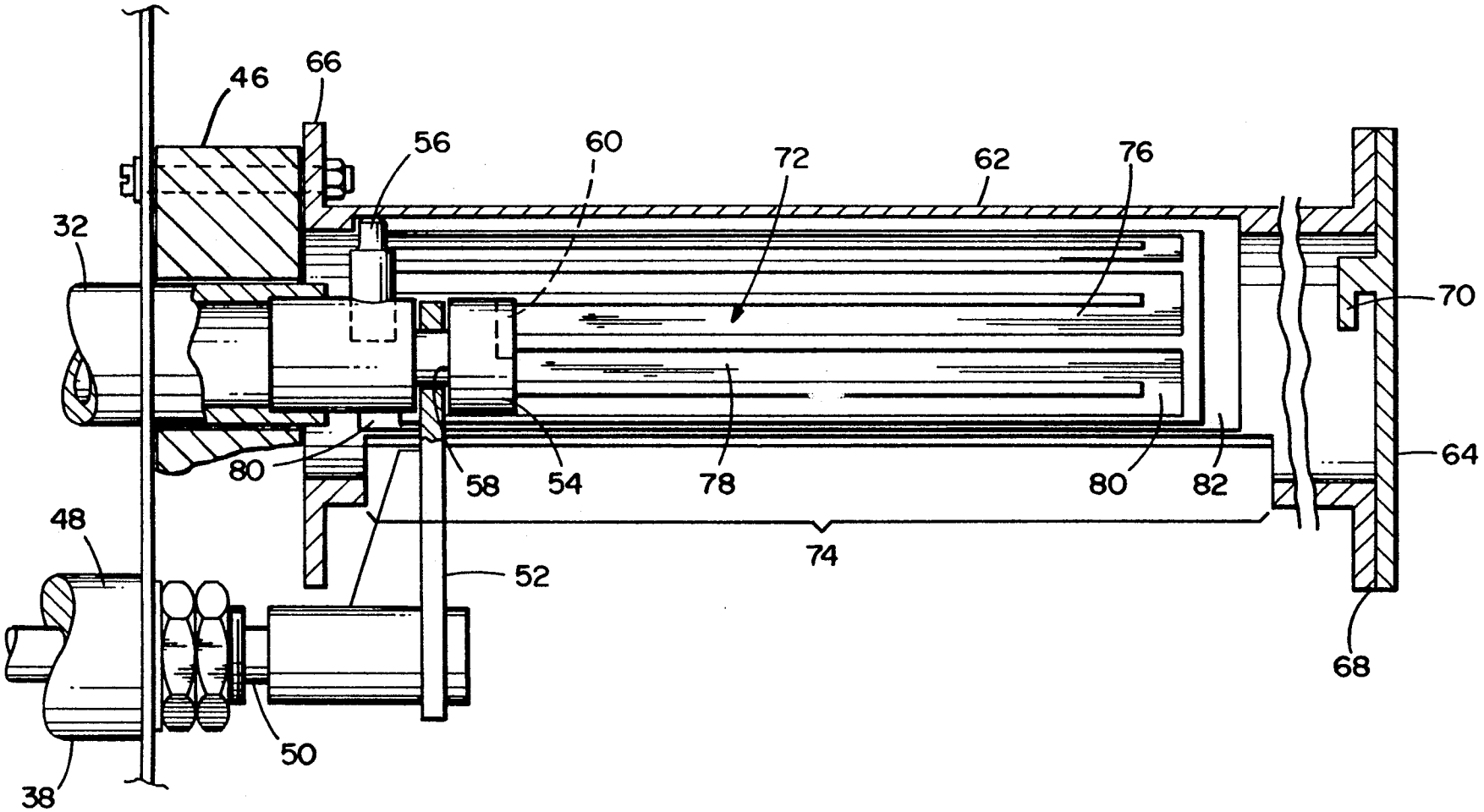
FIG. 2 is an enlarged schematic sectional view of the indexing system used in the shower system shown in FIG. 1.

Referring also to FIG. 2, the driver 38 is adapted to move the movement arm 32 in a reciprocating longitudinal path. The driver 38 includes an air cylinder 48, an air cylinder rod 50, and a bracket 52. Air pressure is applied to the air cylinder 48 by the controller 40 to control the motion of the air cylinder rod 50. A coupling 54 is connected to a second end of the movement arm 32 which includes a dowel pin 56, an annular groove 58, and an end slot 60. The bracket 52 has a slot at one end such that the end of the bracket can be placed in the coupling annular groove 58 to thereby connect the bracket 52 to the movement arm 32. The connection between the bracket 52 and the coupling 54 allows the air cylinder 48 to reciprocatingly move the movement arm in a linear path, but still allow the movement arm to axially rotate relative to the bracket 52. However, any suitable means to reciprocatingly move the movement arm 32 could be provided.

Figure 4:
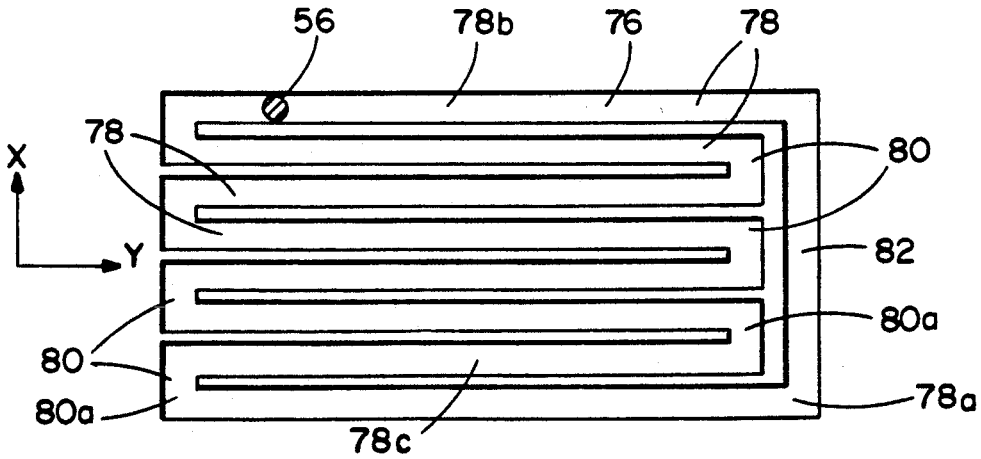
FIG. 4 is a diagrammatical view of the indexing slots and grooves of the indexing spindle shown in FIG. 2.

The indexing system 36 is generally provided to restrict and guide axial rotation of the movement arm 32. The indexing system 36 generally comprises an indexing spindle 62, a stop plate 64, the dowel pin 56 on the coupling 54, and the slot 60 at the end of the coupling 54. The spindle 62 has a first end 66 that is fixedly connected to the machine housing 14 using one of the bearing blocks 46, a second end 68 that has the stop plate 64 fixed to it, a center channel 72, a bottom slot 74, and a slot and groove pattern 76 along the interior wall of the channel 72. FIG. 1 shows the spindle 62 with a center cut-away section in order to show how the bracket 52 and coupling 54 are located relative to each other. As can be best seen from the diagrammatic view of the slot and groove pattern shown in FIG. 4, the slot and groove pattern 76 generally comprises a plurality of longitudinal slots 78, transverse grooves 80 between adjacent slots 78, and an end return groove 82. The transverse grooves 80 are alternatingly arranged such that a general serpentine path is established. The end return groove 82 is provided to establish a loop between a starting slot 78*a* and a finishing slot 78*b*. The slots 78 and grooves 80 and 82 are suitably sized and shaped to allow the dowel pin 56 to move therein. The slots 78 are offset from each other at about 18° relative to the center axis of the center channel 72 such that when the dowel pin 56 moves from one slot 78 to another, by means of a transverse groove 80, the movement arm 32 is limited to about an 18° axial rotation between longitudinal movements of the movement arm 32. However, any suitable type or degree of limited axial rotation could be provided by varying the slots 78 or their relationship to each other. The bottom slot 74 through the spindle 62 allows the bracket 52 to move therein. The stop plate 64 has a stop bar 70 thereon. The stop bar 70 is adapted to stop movement of the movement arm 32 when contacted by the coupling 54. However, the coupling slot 60 is suitably sized, shaped, and positioned to receive the stop bar 70 therein when the dowel pin 56 is located in the end return groove 82. This arrangement allows the longitudinal movement of movement arm 32 to be stopped at a first longitudinal position, when the end of the coupling 54 contacts the stop bar 70, when the dowel pin 56 is in any of the slots 78 except slots 78*a* and 78*b*. However, when the dowel pin 56 is at the end of finishing slot 78*b* the slot 60 allows longitudinal movement of the movement arm 32 to exceed the first longitudinal position and extend to a second extended longitudinal position such that the pin 56 can access the end return groove 82. This extending movement of the movement arm 32 to the second position is also used to signal the controller 40, by means of extended movement of the driver 38, that the shower system has completed a full cycle of showering as further described below. However, any suitable type of means could be provided to signal completion of a full cycle of showering. In addition, any suitable type of indexing system could be provided.

In operation, the shower system 12 will be started with the dowel pin 56 located in the starting slot 78*a*. The driver is actuated to longitudinally move the movement arm 32 by means of the rod 50 with the pin 56 traveling in the starting slot 78*a* towards the first groove 80*a*. At the same time, the pump 34 is actuated to supply fluid through tube 42, through hose 44, and through arms 32 and 30, to the nozzles 28. In a preferred embodiment, the pressure at the discharge of the pump 34 is about 1000 psig. However, any suitable pressure could be provided including higher pressures. This starting position has the torque arms 30 located in a down starting position A shown in FIG. 3. The fluid spray S from the nozzles 28, due to the offset direction of discharge, exerts a torque T on the movement arm 32 equal to the nozzle reactionary force F times the offset length L as shown in FIG. 5. However, because dowel pin 56 is constrained in the starting slot 78*a*, the movement arm 32 is prevented from axially rotating. When the movement arm 32 reaches the forward end of its travel path, the dowel pin 56 encounters the first groove 80*a*. The torque force by the discharge of the fluid from the nozzles 28 then axially rotates the movement arm 32 with the dowel pin 56 moving from the first slot 78*a* to the second slot 78*c*. Axial rotation is stopped by contact of the dowel pin 56 with a wall of the second slot 78*c*. In the embodiment shown, the driver 38 has suitable sensors or switches (not shown) that are connected to the controller 40. The sensors signal the controller when the rod 50 reaches predetermined positions relative to the air cylinder 48, such as when the movement arm 32 reaches its first or second longitudinal positions or its third position at the forward end of its travel path. In alternate embodiments, suitable sensors or switches could be connected or triggered directly by the movement arm 32. Of course, any suitable type of sensing or control system could be provided.

Upon sensing that the movement arm 32 has reached the forward end of its travel path, the controller 40 reverses direction of the driver 38. The longitudinal movement of the movement arm 32 is thus reversed and the dowel pin 56 then travels along the second slot 78*c*. The second slot 78*c*, similar to the first slot 78*a* cooperates with the dowel pin 56 to prevent the force of the fluid discharge at the nozzles 28 from axially rotating the movement arm 32, at least until the pin 56 reaches the second groove 80*b* when the movement arm 32 is allowed to once again axially rotate, a limited amount, and the driver 38 is once again reversed. The position of the torque arms 30 while the pin 56 is in the second slot 78*c* is shown at position B in FIG. 3. These longitudinal movements along the slots 78 and incremental axial rotations at the end of longitudinal movements continue along the remainder of the slots and grooves until the end of the showering cycle. As shown in FIG. 3, the spray S overlaps in positions A, B, and other positions shown, to allow the entire surface of the screen 16 to be showered as the showering cycle continues. The longitudinal reciprocal movements of the movement arm 32 and the force from the discharge of fluid from the nozzles 28 allows a stepwise sweeping spraying pattern to be provided. However, it should be noted that any suitable type of pattern could be provided.

The end of the showering cycle generally comprises the dowel pin 56 traveling along the finishing slot 78*b* and into the end return groove 82. The slot 60 in the coupling 54 accommodates the stop bar 70 to allow the movement arm to extend past its first position to its second extended position. This movement is then signaled to the controller 40 which deactivates the pump and the driver 38. With no fluid being supplied to the shower system 12, the spray S stops and the torque force from the discharge is eliminated. The weight of the torque arms 30 then cause the movement arm 32 to axially rotate back to its starting position, via gravity, with the dowel pin 56 moving through end return groove 82. The shower system 12 is thus ready to start a new showering cycle when desired.

Figure 6:
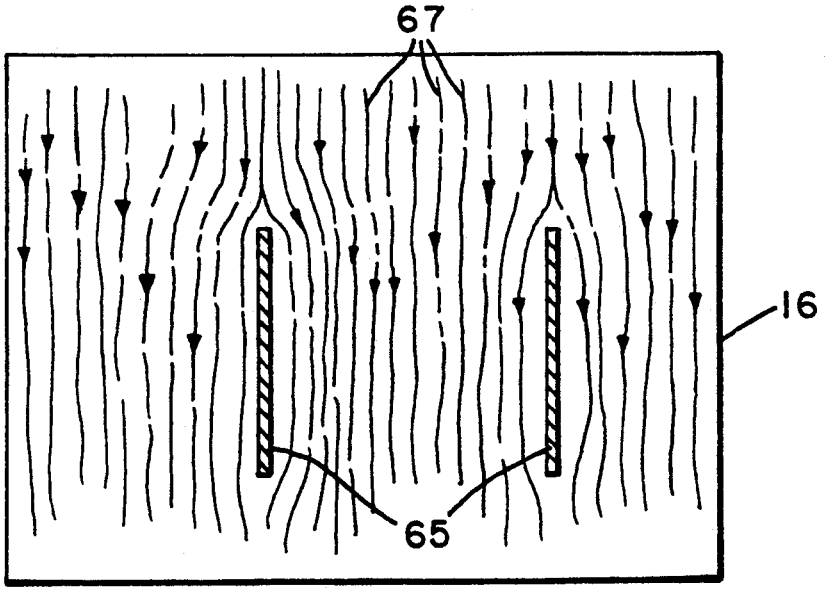
FIG. 6 is a view taken in the direction of the arrow F in FIG. 5 showing the spray pattern as it impinges on the screen.

Referring to FIG. 6, it will be noted that the spray pattern from nozzle 28 (FIG. 1) takes the form of a relatively narrow high-energy band 65 less than 10° in spray width and oriented parallel to the feed stream 67, which is capable of slightly deflecting the feed stream 67 so that cleaning energy is concentrated upon the screen 16 unencumbered by the feed stream. As shown in FIG. 6, the narrow patterns or bands 65 appear to be vertically oriented, but it will be understood that they are arcuate and follow the curvature of the screen surface 16. This high-energy spray band or pattern enables the cleaning process to be carried out without shutting down the operation of the screening machine, with attendant loss of time and production. The longitudinal arc of the spray can be varied depending on the nature of the feed and the difficulty of the cleaning process. For certain feeds, a longitudinal spray arc of about 65° has been employed, but to obtain higher cleaning energy a smaller arc may be selected, down to 45° or less. Where a lower cleaning energy is satisfactory, arcs greater than 65° may be used. The distance from the nozzle 28 to screen 16 can also be varied depending on the nature of the feed as indicated above. For certain feeds, distances of 4 to 8 inches have been successfully employed and depending on the circumstances, distances outside this range may be used.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A shower system comprising:

a movement arm having a plurality of spray nozzles along the length thereof;

each of said spray nozzles connected to said movement arm by means of a torque arm; and means for moving the movement arm in a reciprocating longitudinal path and an axial rotational direction, the means for moving including means for providing axial rotation of the movement arm only upon a predetermined longitudinal movement of the movement arm.

2. A system as in claim 1 wherein the means for moving includes a drive system connected to the movement arm adapted to reciprocatingly move the movement arm.

3. A system as in claim 2 wherein the means for providing axial rotation includes an indexing system adapted to prevent axial rotation of the movement arm except at predetermined positions of the movement arm relative to the indexing system.

4. A system as in claim 3 wherein the means for providing axial rotation includes the spray nozzle having a spray discharge in a direction offset from the radial axis of the movement arm to thereby apply a torque force to the movement arm when fluid is sprayed from the nozzle.

5. A system as in claim 4 wherein the indexing system includes an indexing spindle having longitudinal slots therein and, the movement arm includes a pin adapted to move in the longitudinal slots.

6. A screening machine cleaning system comprising:

at least one spray nozzle;

a movement arm having the spray nozzle connected thereto;

means for supplying fluid to the spray nozzle;

means for reciprocatingly longitudinally moving the movement arm; and an indexing means for, at least partially, controlling axial rotation of the movement arm, the indexing means including a spindle with slots for a portion of the movement arm to move therein.

7. A system as in claim 6 wherein the spray nozzle is connected to the movement arm by means of a torque arm.

8. A system as in claim 7 wherein the movement arm and torque arm comprise channels for fluid to flow to the spray nozzle.

9. A system as in claim 8 wherein the spindle has alternating grooves between slots at opposite ends of the spindle for the portion of the movement arm to move between slots.

10. A system as in claim 9 wherein the spindle has a groove to allow the movement arm to return to a starting position upon a predetermined number of axial rotations and longitudinal movements.

* * * * *